US012631420B2

(12) United States Patent
Nielsen

(10) Patent No.: US 12,631,420 B2
(45) Date of Patent: May 19, 2026

(54) RIFLE ACTION CLEANING TOOL

(71) Applicant: Kristian Nielsen, Chicago, IL (US)

(72) Inventor: Kristian Nielsen, Chicago, IL (US)

(73) Assignee: TITAN PRODUCT DEVELOPMENT, LLC, Chicago, IL (US)

( * ) Notice: Subject to any disclaimer, the term of this patent is extended or adjusted under 35 U.S.C. 154(b) by 0 days.

(21) Appl. No.: 19/045,423

(22) Filed: Feb. 4, 2025

(65) Prior Publication Data

US 2025/0257971 A1 Aug. 14, 2025

Related U.S. Application Data

(60) Provisional application No. 63/551,155, filed on Feb. 8, 2024.

(51) Int. Cl.
*F41A 29/02* (2006.01)

(52) U.S. Cl.
CPC ..... *F41A 29/02* (2013.01)

(58) Field of Classification Search
CPC ..... F41A 29/00; F41A 29/02
USPC ..... 42/95
See application file for complete search history.

(56) References Cited

U.S. PATENT DOCUMENTS 4,144,609 A * 3/1979 Dubs ..... F41A 29/02 15/181
11,473,868 B2 * 10/2022 Hoodecheck ..... F41A 29/02

FOREIGN PATENT DOCUMENTS

CH 330862 A * 6/1958 ..... F41A 29/02

OTHER PUBLICATIONS

CH 330862 A (English Translation) (Year: 1958).*

* cited by examiner

*Primary Examiner* — Reginald S Tillman, Jr.
(74) *Attorney, Agent, or Firm* — Justin Lampel

(57) ABSTRACT

A rifle action cleaning tool is provided. The rifle action cleaning tool is especially suitable for effectively and quickly cleaning the raceway and lug recesses of a rifle action. The cleaning tool has a cleaning rod attached to a first cleaning portion and a second cleaning portion. The first cleaning portion (which may have bristles) may rotate three hundred and sixty degrees prior to entering raceway of the rifle while the second cleaning portion (which may have a swab or sponge) remains fixed to the cleaning rod and rotates three hundred and sixty degrees along with a handle portion of the cleaning rod. More specifically, the first cleaning portion may rotate independent from the second cleaning portion.

10 Claims, 3 Drawing Sheets

RIFLE ACTION CLEANING TOOL

CROSS REFERENCE TO RELATED APPLICATIONS

The following application is a based on and claims the priority benefit of U.S. provisional application Ser. No. 63/551,155 filed Feb. 8, 2024; the entire content of which is incorporated by reference.

BACKGROUND OF THE INVENTION

A rifle action cleaning tool is provided. The rifle action cleaning tool is especially suitable for effectively and quickly cleaning the raceway and lug recesses of a rifle action. The cleaning tool has a cleaning rod attached to a first cleaning portion and a second cleaning portion. The first cleaning portion (which may have bristles) may rotate three hundred and sixty degrees prior to entering raceway of the rifle while the second cleaning portion (which may have a swab or sponge) remains fixed to the cleaning rod and rotates three hundred and sixty degrees along with a handle portion of the cleaning rod. More specifically, the first cleaning portion may rotate independent from the second cleaning portion.

Tools for cleaning rifles are known. For example, U.S. Patent Publication No.: 2015035491 to Otter discloses a breech chamber cleaning tool. The breech chamber cleaning tool has a bar angled so as to form at one end a handle for gripping the tool by hand and at the other end a head for scraping the breech chamber.

Further, U.S. Pat. No. 8,250,800 to Johnson discloses a rifle chamber cleaning tool having a single piece of material with an annular scraping head and a plurality of elongated fingers, comprising debris capturing chambers within the elongated fingers. The scraping head and fingers are shaped so as to fit snugly when inserted between the lug recesses inside the rifle chamber. The distance between the fingers is roughly equivalent to the distance between the locking lugs inside the rifle chamber.

Still further, U.S. Pat. No. 5,588,242 to Hughes discloses a lightweight, portable polymeric gun cleaning rod and method for use having various implements such as brushes, jags, and the like. The cleaning rod shaft is formed from a polymeric composition such as nylon which can be manually worked through the gun barrel during cleaning. A fitting is attached at one end of the shaft for convenient, threadable reception of cleaning implements. After use the cleaning implements can be easily removed and the cleaning rod shaft manually coiled for compact storage.

However, these patent documents fail to describe a rifle action cleaning tool which is easy to use. Further, these patent documents fail to provide for a rifle action cleaning tool which has a first cleaning portion and a second cleaning portion.

SUMMARY OF THE INVENTION

A rifle action cleaning tool is provided. The rifle action cleaning tool is especially suitable for effectively and quickly cleaning the raceway and lug recesses of a rifle action. The cleaning tool has a cleaning rod attached to a first cleaning portion and a second cleaning portion. The first cleaning portion (which may have bristles) may rotate three hundred and sixty degrees prior to entering raceway of the rifle while the second cleaning portion (which may have a swab or sponge) remains fixed to the cleaning rod and rotates three hundred and sixty degrees along with a handle portion of the cleaning rod. More specifically, the first cleaning portion may rotate independent from the second cleaning portion.

An advantage of the present rifle action cleaning tool is that the present tool is easy to use.

Another advantage of the present rifle action cleaning tool is that the present tool is durable.

Yet another advantage of the present rifle action cleaning tool is that a single tool may be used to perform the cleaning tasks which would otherwise require two separate tools.

For a more complete understanding of the above listed features and advantages of the rifle action cleaning tool reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

Figure 1:
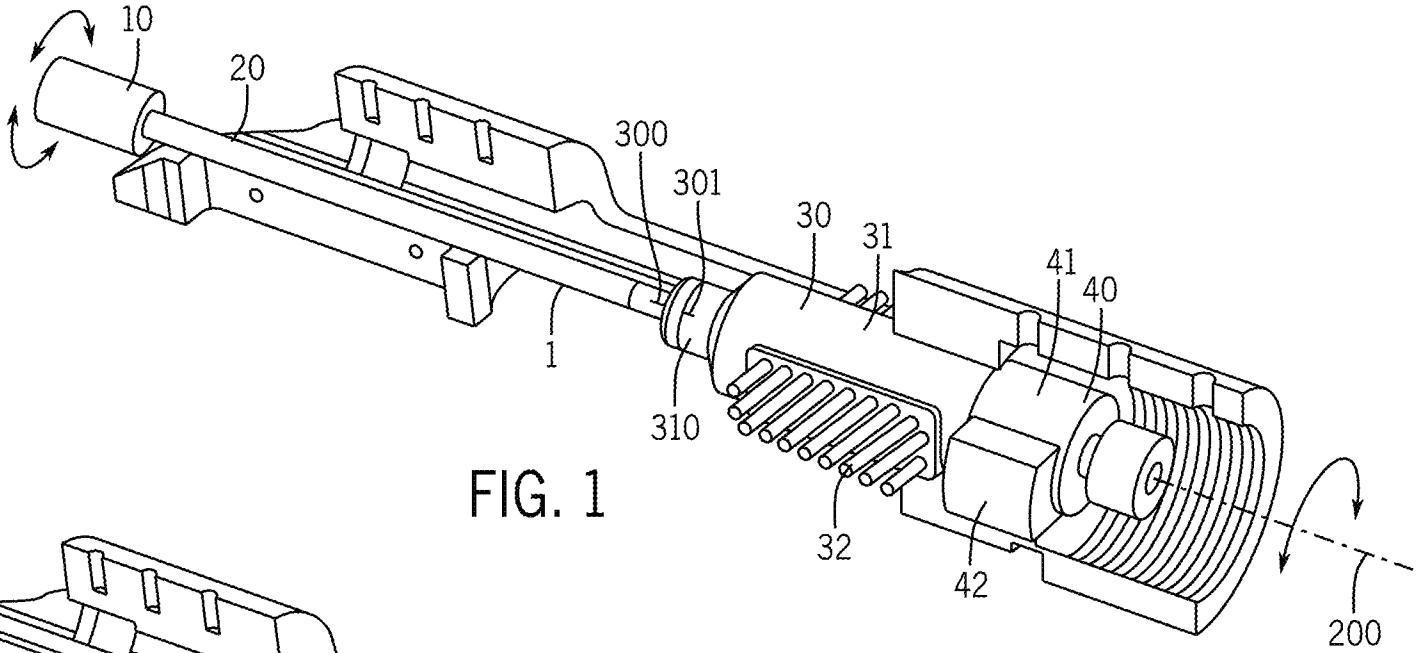
FIG. 1 illustrates a perspective view of the rifle action cleaning tool located within a rifle raceway.
Figure 2:
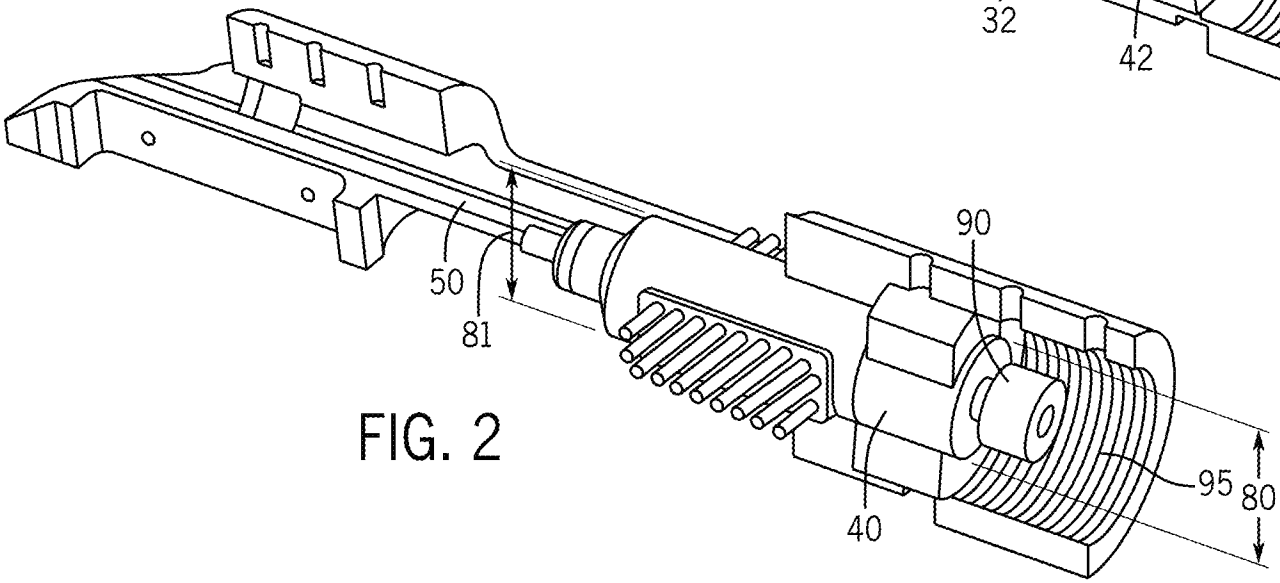
FIG. 2 illustrates the rifle action cleaning tool of FIG. 1 wherein the extended rod portion is removed for better illustrating the interior of the rifle and wherein the second cleaning portion is rotated compared to FIG. 1.
Figure 3:
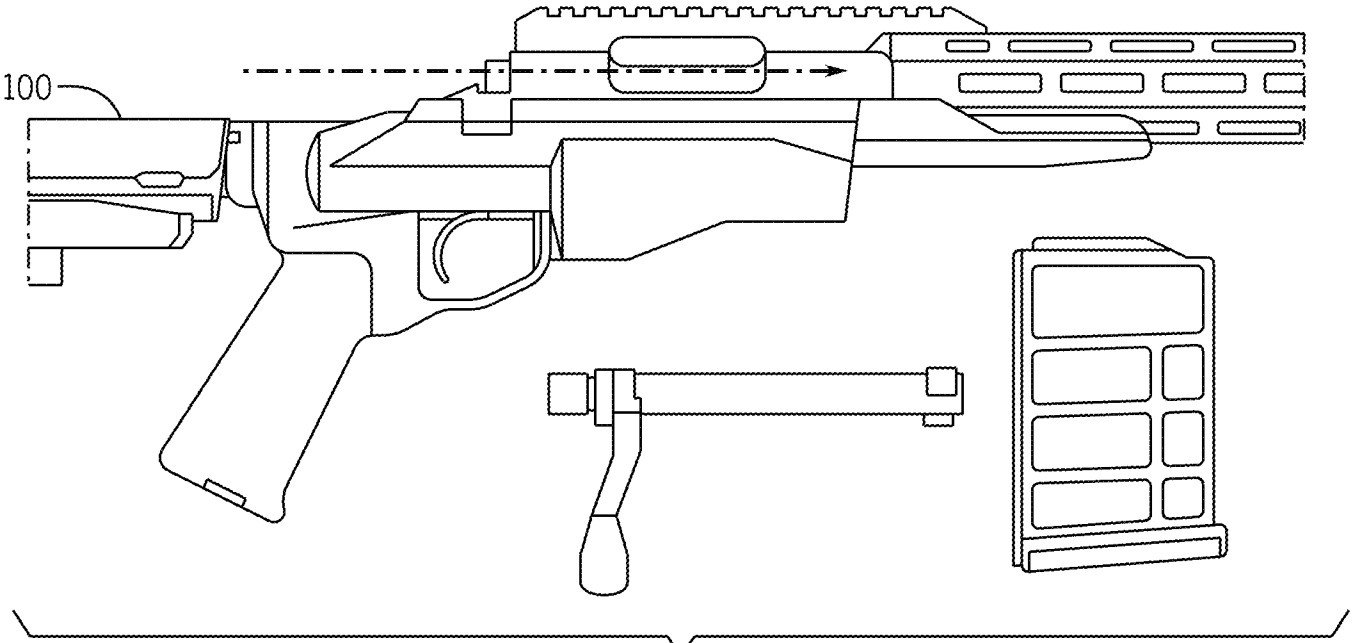
FIG. 3 illustrates a side view of a rifle with a dotted arrow line illustrating where the tool is placed.

A rifle action cleaning tool is provided. The rifle action cleaning tool is especially suitable for effectively and quickly cleaning the raceway and lug recesses of a rifle action. The cleaning tool has a cleaning rod attached to a first cleaning portion and a second cleaning portion. The first cleaning portion (which may have bristles) may rotate three hundred and sixty degrees prior to entering raceway of the rifle while the second cleaning portion (which may have a swab or sponge) remains fixed to the cleaning rod and rotates three hundred and sixty degrees along with a handle portion of the cleaning rod. More specifically, the first cleaning portion may rotate independent from the second cleaning portion.

The rifle action cleaning tool 1 may have a handle portion 10, an extended rod portion 20, a first cleaning portion 30 and a second cleaning portion 40. In an embodiment, the first cleaning portion 30 and the second cleaning portion 40 have a side which is at least partially cylindrical so as to fit within and clean the interior of a rifle 100. The tool 1 is especially suitable for cleaning the interior walls of a raceway 50 of a rifle 100. The extended rod portion 20 is generally an elongated cylindrical rod with a threaded member which allows it to be attached to the terminal end of a housing 31 of the first cleaning portion 30. The elongated extended rod 20 is connected to the handle portion 10 which allows the user to control the rifle action cleaning tool 1.

In an embodiment, located on the exterior surface of a main housing 31 of the first cleaning portion 30 may be a brush portion 32. The brush portion 32 may be made of a plurality of elongated flexible bristles which can clean the interior of the rifle 100. In an embodiment, the bristles 32 are made of nylon. The elongated flexible bristles of the brush 32 are designed to clean the interior walls of the raceway 50 of the rifle 100 by scrubbing the interior walls of the raceway 50 as the rile action cleaning tool 1 is inserted into and removed (repeatedly) from the raceway 50 of the rifle 100. In an embodiment, two separate bristle portions 32 may be located on opposition sides of the main housing 31 of the first cleaning portion 30.

Figure 4:
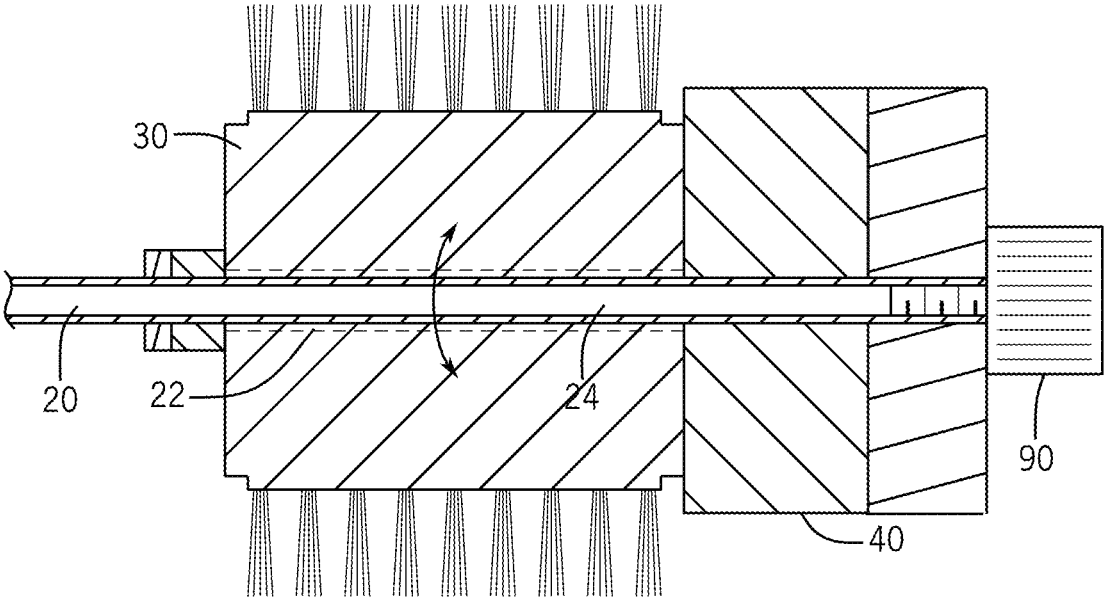
FIG. 4 illustrates a cross-sectional interior view of the main housing of the first and second cleaning portions.
Figure 5:
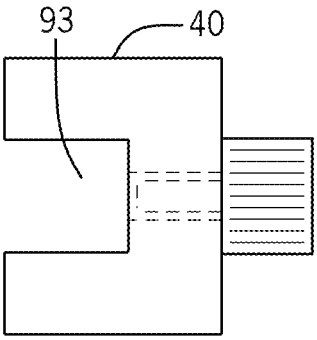
FIG. 5 illustrates a side view of the second cleaning portion with the swab portion removed.

In an embodiment, the main housing 31 of the first cleaning portion 30 may have an interior 22 (FIG. 4). The interior of the main housing 31 of the first cleaning portion 30 may have an internal rod 24 that connects to the extended rod 20. When the extended rod 20 is rotated by the handle portion 10, the extended rod 20 rotates the internal rod 24 within the interior 22 of the first cleaning portion 30 which then rotates the second cleaning portion 40. As a result, turning the handle portion 10 rotates the second cleaning portion 40, but does not rotate the first cleaning portion 30.

In an embodiment, the first cleaning portion 30 may rotate three hundred and sixty degrees along the x-axis 200 until the bristles 32 hit the raceway 50, which therein prevents the first cleaning portion 30 from rotating along the x-axis 200. With the first cleaning portion 30 captured by the raceway 50, the second cleaning portion 40 may now rotate by the user turning the handle portion 10.

In an embodiment, the second cleaning portion 40 is located on a generally cylindrical housing portion 41. The generally cylindrical housing portion 41 of the second cleaning portion 40 has a diameter 80 substantially equal to a diameter 81 of the main housing 31 of the first cleaning portion 30. Both the main housing portion 31 of the first cleaning portion 30 and the main housing portion 41 of the second cleaning portion 40 have a diameter greater than the diameter of the extended rod 20. The main housing 41 of the second cleaning portion 40 rotates in unison around the x-axis 200 along with the handle portion 10.

The second cleaning portion 40 may have, for example, a sponge-like "or swab" cleaning portion 42, which is distinct from the flexible bristle portion 32 of the first cleaning portion 30. The second cleaning portion 40 is designed to reach and clean a lug recess portion 95 of the rifle 100 which is generally difficult to reach and clean. A turning knob 90 located at the distal end of the tool 1 allows a user to further adjust the position of the second cleaning portion 30. The turning knob 90 is also used to secure the second cleaning portion 40 to the reminder of the tool 1. In particular, the turning knob 90 may be the end cap that keeps the second cleaning portion 40 secured next to the first cleaning portion 30.

Figure 6:
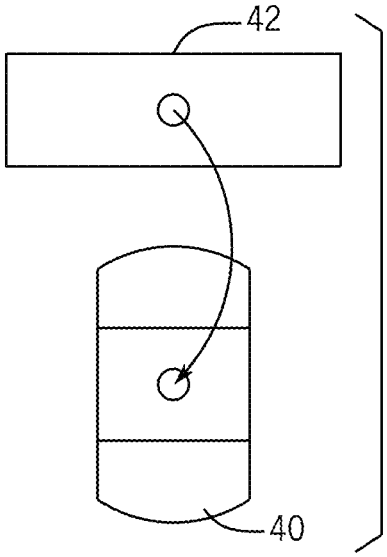
FIG. 6 illustrates a bottom view of the second cleaning portion with the swab portion being inserted into the second cleaning portion.

To replace the used swab portion 42 of the second cleaning portion 40 with a new swab portion 42, the user removes the turning knob 90 from the tool 1 by either unscrewing the turning knob 90 or by removing a screw (not shown) which passes through the turning knob 90. In an embodiment, the swab portion 42 of the second cleaning portion 40 is replaceable once it becomes dirty or damaged. In particular, the swab portion 42 may be a generally rectangular unit as shown in FIG. 6. A user may insert the swab portion 42 into a three-sided opening passageway 93 which passes through the second cleaning unit 40 to replace the swab portion 42 with a clean swab portion 42. The second cleaning portion 40, with the new swab portion 42 added, is then reattached to the tool 1 at the end of the main housing 31 of the first cleaning portion 30. A screw then may be used to resecure the second cleaning portion 40 to the first cleaning portion 30.

The first cleaning portion 30 acts as a bearing for the second cleaning portion 40 to rotate once the first cleaning portion 30 is captured in the raceways. The first cleaning portion 30 is not meant to rotate as a part of its function, though is does rotate freely on the extended rod 20 before being inserted into the rifle action.

Because a user may use the presently described single tool to clean both the interior walls of the rifle raceway 50 and the lug recess portion 95 of the rifle 100, the user may save time cleaning his/her rifle 100. Prior cleaning of the interior of a rifle 100 required a user to insert a first tool designed to clean the raceway portion of the rifle and then to remove the first tool and then insert a second tool to reach and to clean the lug recess portion 95 of the rifle 100. The present tool 1 allows a user to clean both portions by rotating the handle portion 10 to clean the lug recess portion 95 of the rifle 100 while also using the bristles 32 of the first cleaning portion 30 to clean the raceway.

To use the device 1, a user inserts the device 1 into the bolt raceway 50 with the bristles 32 and swab 42 aligned (as shown in FIG. 1). When the device 1 is fully inserted, the user may rotate the handle portion 10. Rotating the handle portion 10 rotates the second cleaning portion 40 around x-axis 200 while the first cleaning portion 30 remains stationary within the rifle 100. The second cleaning 40 then cleans the locking lug area 95 of the rifle 100.

In an embodiment, a first visual indicator 300, such as a red line, is located on the extended rod portion 20 and a second visual indicator 301, such as a red line, is located on the back end 310 of the first housing 31 portion of the first cleaning portion 30. When the two visual indicators 300, 301 are aligned, the bristles 31 of the first cleaning portion 30 and the swab portion 42 of the second cleaning 40 are also aligned as shown in FIG. 1, and the device 1 may be inserted or removed from the rifle 100. When the visual indicators 300, 301 are not aligned, the tool 1 may not be inserted or removed from the rifle 100.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A rifle action cleaning tool comprising: an extended rod portion; a first cleaning portion secured to the extended rod portion wherein the first cleaning portion has a first cleaning implement; a second cleaning portion wherein the second cleaning portion has a second cleaning implement and wherein the second cleaning portion rotates independent of the first cleaning portion; and a turning knob wherein the turning knob secures the second cleaning portion to the first cleaning portion; and wherein the second cleaning implement of the second cleaning tool is a swab.

2. A rifle action cleaning tool comprising: an extended rod portion; a first cleaning portion secured to the extended rod portion wherein the first cleaning portion has a first cleaning implement; a second cleaning portion wherein the second cleaning portion has a second cleaning implement and wherein the second cleaning portion rotates independent of the first cleaning portion; and an opening passageway which passes through the second cleaning portion wherein the opening passageway receives the second cleaning implement.

3. A rifle action cleaning tool comprising: an extended rod portion; a first cleaning portion secured to the extended rod portion wherein the first cleaning portion has a first cleaning implement; a second cleaning portion wherein the second cleaning portion has a second cleaning implement and wherein the second cleaning portion rotates independent of the first cleaning portion; and a first visual indicator located on the extended rod portion and a second visual indicator located on the first cleaning portion wherein the alignment of the first visual indicator and the second visual indicator is required to insert or remove the tool from the rifle.

4. A rifle action cleaning tool comprising: an extended rod portion; a first cleaning portion secured to the extended rod portion wherein the first cleaning portion has a first cleaning implement; a second cleaning portion wherein the second cleaning portion has a second cleaning implement and wherein the second cleaning portion rotates independent of the first cleaning portion; and a rod located within an interior of the first cleaning portion wherein the rod is capable of rotating the second cleaning portion while not rotating the first cleaning portion.

5. The rifle cleaning tool of claim 1 wherein the turning knob is removably screwed to the tool by a screw.

6. The rifle cleaning tool of claim 1 wherein the second cleaning portion has an opening passageway and wherein the opening passageway receives a removable and replaceable cleaning swab portion.

7. A rifle action cleaning tool comprising: an extended rod portion; a first cleaning portion secured to the extended rod portion wherein the first cleaning portion has a first cleaning implement; a second cleaning portion wherein the second cleaning portion has a second cleaning implement and wherein the second cleaning portion rotates independent of the first cleaning portion; a turning knob wherein the turning knob secures the second cleaning portion to the first cleaning portion; and a first visual indicator located on the extended rod portion and a second visual indicator located on the first cleaning portion wherein the alignment of the first visual indicator and the second visual indicator is required to insert or remove the tool from the rifle.

8. A rifle action cleaning tool comprising: an extended rod portion; a first cleaning portion secured to the extended rod portion wherein the first cleaning portion has a first cleaning implement; a second cleaning portion wherein the second cleaning portion has a second cleaning implement and wherein the second cleaning portion rotates independent of the first cleaning portion; a turning knob wherein the turning knob secures the second cleaning portion to the first cleaning portion; and an opening passageway which passes through the second cleaning portion wherein the opening passageway receives the second cleaning implement.

9. A rifle action cleaning tool comprising: an extended rod portion; a first cleaning portion secured to the extended rod portion wherein the first cleaning portion has a first cleaning implement; a second cleaning portion wherein the second cleaning portion has a second cleaning implement and wherein the second cleaning portion rotates independent of the first cleaning portion; a turning knob wherein the turning knob secures the second cleaning portion to the first cleaning portion; and a handle located at a first end of the extended rod portion wherein the handle rotates the second cleaning portion but not the first cleaning portion.

10. A rifle action cleaning tool comprising: an extended rod portion; a first cleaning portion secured to the extended rod portion wherein the first cleaning portion has a first cleaning implement; a second cleaning portion wherein the second cleaning portion has a second cleaning implement and wherein the second cleaning portion rotates independent of the first cleaning portion; a turning knob wherein the turning knob secures the second cleaning portion to the first cleaning portion; and a rod located within an interior of the first cleaning portion wherein the rod is capable of rotating the second cleaning portion while not rotating the first cleaning portion.

* * * * *